US005485777A

United States Patent [19]

Kim

[11] Patent Number: 5,485,777

[45] Date of Patent: Jan. 23, 1996

[54] ABRASION PREVENTING DEVICE FOR HERMETIC RECIPROCATING COMPRESSOR

[75] Inventor: Dong-Hyeon Kim, Seoul, Rep. of Korea

[73] Assignee: Goldstar Co., Ltd., Rep. of Korea

[21] Appl. No.: 309,399

[22] Filed: Sep. 20, 1994

[30] Foreign Application Priority Data

Sep. 21, 1993 [KR] Rep. of Korea ..... 19084/1993

[51] Int. Cl.[6] ..... F16J 1/10

[52] U.S. Cl. ..... 92/84; 92/187; 92/140; 74/50

[58] Field of Search ..... 92/84, 140, 187, 92/72; 417/273, 415, 901; 74/50

[56] References Cited

U.S. PATENT DOCUMENTS 3,735,741 5/1973 Hatz ..... 92/72

FOREIGN PATENT DOCUMENTS 0808493 2/1937 France ..... 92/84
0113587 7/1983 Japan ..... 92/84
2269636 8/1993 United Kingdom ..... 417/273

*Primary Examiner*—Thomas E. Denion
*Attorney, Agent, or Firm*—Ostrolenk, Faber, Gerb & Soffen

[57] ABSTRACT

An abrasion preventing device for a hermetic reciprocating compressor. The device releases the impact generated between the slider and the shell of the compressor, thus to prevent possible abrasion of the contact part between the slider and the shell as well as abrasion of the piston. The device comprises a cylinder and a piston received and reciprocating in the cylinder, an end of the piston having a coupling projection. A shell, which is coupled to the piston, has a coupling projection. A bolt and nuts are used for coupling the piston to the shell by coupling the projections of both the piston and the shell to each other. A spring is provided on a coupling portion between the piston and the shell for absorbing the impact caused by striking of a slider on the shell during an operation of the compressor.

7 Claims, 3 Drawing Sheets

ABRASION PREVENTING DEVICE FOR HERMETIC RECIPROCATING COMPRESSOR

BACKGROUND OF THE INVENTION

1. Field of the Invention

The present invention relates in general to hermetic reciprocating compressors and, more particularly, to a structural improvement in a coupling portion between a piston and a shell of the hermetic reciprocating compressor for preventing abrasion of the piston as well as abrasion of the contact part between a slider and the shell.

2. Description of the Prior Art

As shown in FIGS. 1A to FIG. 1C, the moving part of a typical hermetic reciprocating compressor such as a Scotch yoke compressor comprises a crank shaft part, a slider 2 and a piston part. The crank shaft part includes a cylindrical rotator 6, a crank shaft 7 penetrating the center of the rotator 6, and a counter balance 9 of the hollow tube type mounted on the top of the crank shaft 7. The crank shaft part also includes a crank pin 1 which will be coupled to another crank shaft (not shown). Conventionally, the above elements of the crank shaft part are assembled with each other into the crank shaft part of a single body. The slider 2, which is received in a cylindrical shell 3, has a size of about ½ of the shell 3. The piston part comprises a piston 4 and the shell 3.

In operation of the above compressor, the another crank shaft (not shown) is rotated at the same time of the rotation of the rotator 6 of the moving part. At this time, the slider 2 is rotated due to presence of the crank pin 1. That is, when the drive force is transmitted to the slider 2 through the crank pin 1 connected to the another crank shaft, the piston 4 rectilinearly reciprocates in the cylinder 5 because of the sliding motion of both the slider 2 and the shell 3, thus to suck and compress the gas refrigerant.

In operation of the slider crank mechanism or the above moving part of the hermetic reciprocating compressor, the slider 2 repeatedly strikes on the shell 3 when the torque of a motor (not shown) is transmitted to the piston 4 through the slider 2. The contact part between the slider 2 and the shell 3 of the moving part will thus abrade. Furthermore, the mechanical shock generated when the slider 2 strikes on the shell 3 is inevitably applied on the piston 4, thus to cause the side surface of the piston 4 to repeatedly come into contact with the inner surface of the cylinder 5. The side surface of the piston 4 will thus abrade.

SUMMARY OF THE INVENTION

It is, therefore an object of the present invention to provide an abrasion preventing device for a hermetic reciprocating compressor in which the above problems can be overcome and which release the mechanical shock generated between the slider and the shell of the compressor, thus to prevent possible abrasion of the contact part between the slider and the shell as well as abrasion of the piston.

In order to accomplish the above object, an abrasion preventing device for a hermetic reciprocating compressor in accordance with an embodiment of the present invention comprises: a cylinder; a piston received and reciprocating in the cylinder, an end of the piston having a coupling projection; a shell coupled to the piston, the shell having a coupling projection; means for coupling the piston to the shell by coupling the projections of both the piston and the shell to each other; and elastic means provided on a coupling portion between the piston and the shell.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1A:
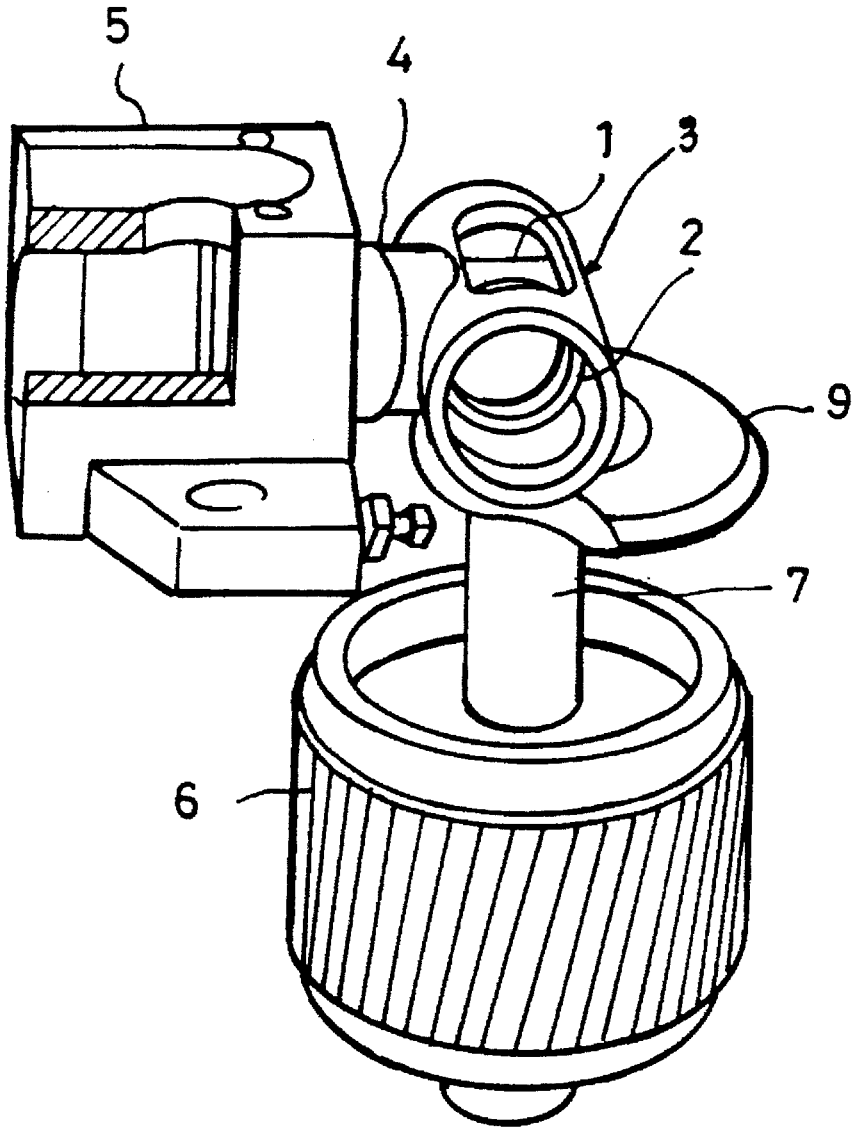
FIG. 1A PRIOR ART
FIG. 1A is a schematic perspective view of a part of a typical hermetic reciprocating compressor.
Figure 1B:
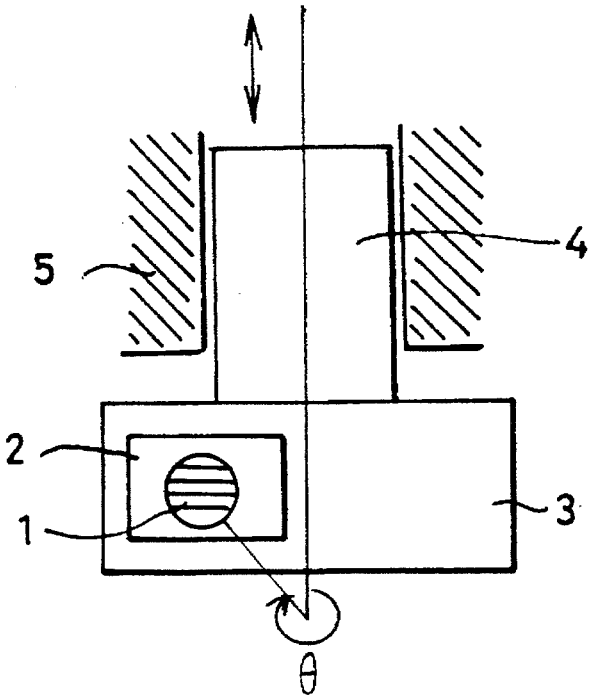
FIG. 1B PRIOR ART
FIG. 1B is a plan view of a slider crank mechanism of the compressor of FIG. 1.
Figure 1C:
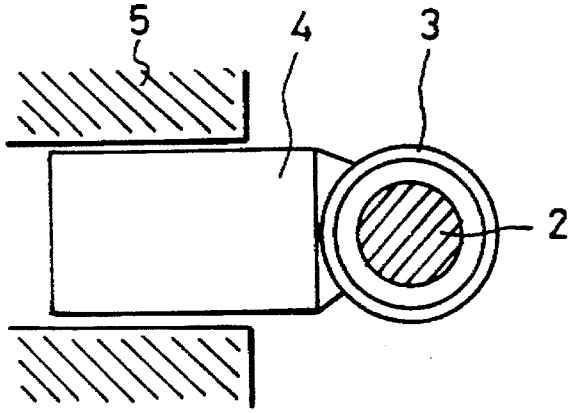
FIG. 1C PRIOR ART
FIG. 1C is a side sectional view of the slider crank mechanism of the compressor of FIG. 1.
Figure 2A:
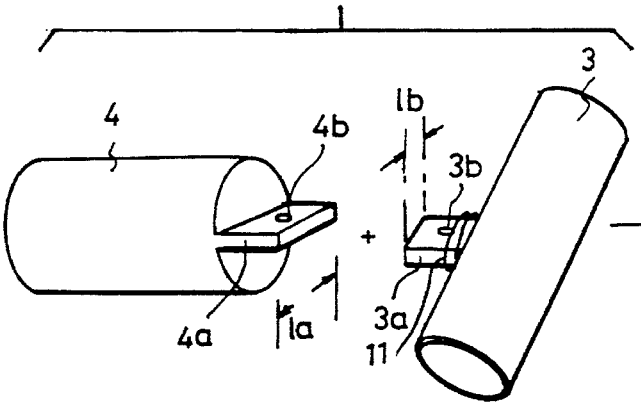
FIG. 2A is a schematic view showing an abrasion preventing coupling structure of both a piston and a shell of the compressor in accordance with a primary embodiment of the present invention.
Figures 1, 2A:
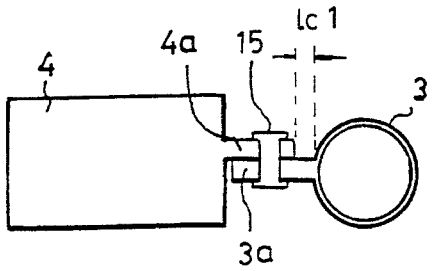
Figure 2B:
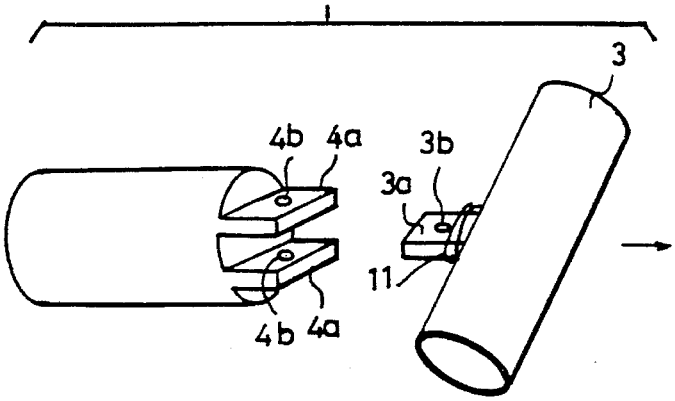
FIG. 2B is a view corresponding to FIG. 2A, but showing the second embodiment of the present invention.
Figures 1, 2B:
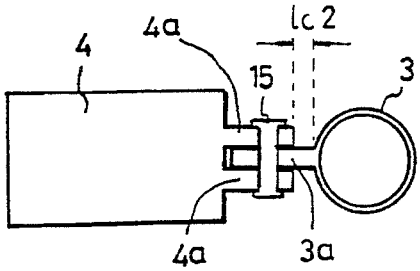
Figure 2C:
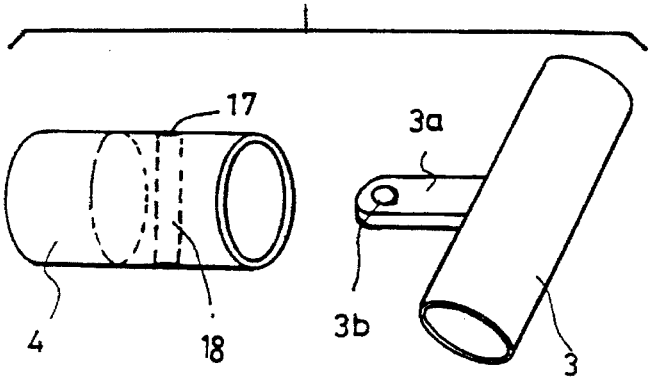
FIG. 2C is a view corresponding to FIG. 2A, but showing the third embodiment of the present invention.
Figures 1, 2C:
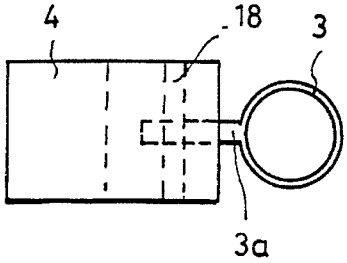

With reference to FIGS. 2A to 2C, there are shown pistonshell coupling structures of hermetic reciprocating compressors suitable for preventing abrasion of all of a slider, a shell and a piston in accordance with different embodiments of the present invention respectively.

As shown FIG. 2A, an abrasion preventing device according to a primary embodiment of the present invention includes a piston 4 having a coupling projection 4*a*. The coupling projection 4*a*, having both a predetermined width and a predetermined thickness, extends from an end of the piston 4 and has a coupling hole 4*b*. The hole 4*b* is formed by vertically holing the projection 4*a*. The device also includes a cylindrical shell 3 coupled to the piston 4. In the same manner as described for the piston 4, the shell 3 is provided with a coupling projection 3*a*, which projection 3*a* extends from a side surface of a middle portion of the shell 3. The coupling projection 3*a*, having a size similar to that of the projection 4*a* of the piston 4, is provided with a coupling hole 3*b*. Here, it is preferred to form the shell 3 and the piston 4 and their projections 3*a* and 4*a* in single bodies respectively. However, it should be understood that the projections 3*a* and 4*a* may be separately formed from the shell 3 and the piston 4 respectively and, thereafter, welded to the predetermined portions of the shell 3 and the piston 4.

FIG. 2B shows an abrasion preventing device according to a second embodiment of the present invention. In the second embodiment, the piston 4 has a pair of coupling projections 4*a* which extend in parallel from the end of the piston 4. The projections 4*a* of the piston 4 are spaced apart from each other so that they receive the coupling projection 3*a* of the shell 3 in a space defined between the projections 4*a*. In the same manner as described for the projection 4*a* of the primary embodiment, the coupling projections 4*a* of the second embodiment have their respective coupling holes 4*b*. The projections 4*a* of the piston 4 are coupled to the coupling projection 3*a* of the shell 3 in the same manner as described for the primary embodiment. Of course, it should be understood that three or more coupling projections 4*a* may be provided on the end of the piston 4 without affecting the functioning of this invention.

It is preferred to make the width la of the coupling projection 4*a* of the piston 4 be twice the width lb of the coupling projection 3a of the shell 3, so that the shell 3 is free from striking on the piston 4 during operation of the compressor.

Each of the abrasion preventing device according to the primary and second embodiments further includes high stiffness elastic means 11 provided on the projection 3a of the shell 3. In order to couple the piston 4 to the shell 3 with the elastic means 11, the piston 4 is placed with respect to the shell 3 so that the coupling hole 4b of the projection 4a of the piston 4 is aligned with the coupling hole 3b of the projection 3a of the shell 3. At this time, the elastic means 11 is placed about the projection 3a of the shell 3 prior to placing of the piston 4 with respect to the shell 3. The coupling projections 3a and 4a, after being aligned with each other, are coupled to each other by a bolt 15 and nuts 16. When accomplishing the coupling of the piston 4 to the shell 3, the elastic means 11 will be placed in the space of a length $lc_1$ between the front end of the projection 4a of the piston 4 and the side surface of the shell 3. That is, opposed ends of the elastic means 11 are stopped by the front end of the projection 4a of the piston 4 and the side surface of the shell 3 respectively. Meanwhile, the elastic means I1 of the abrasion preventing device according to the second embodiment is placed in the space of a length $lc_2$ between the front ends of the projections 4a of the piston 4 and the side surface of the shell 3. That is, opposed ends of the elastic means 11 of the second embodiment are stopped by the front ends of the projections 4a of the piston 4 and the side surface of the shell 3 respectively.

Please noted that the slider is not shown in FIGS. 2A and 2B in order for showing both the shell 3 and the piston 4 in detail.

In accordance with the abrasion preventing device according to either the primary embodiment or the second embodiment, possible abrasion of the coupling portion between the shell 3 and the piston 4 as well as possible abrasion of the piston 4 will be prevented. That is, even when the aggrandized moment caused by striking of the slider on the shell 3 during the operation of the compressor is applied on the coupling portion between the shell 3 and the piston 4 through the shell 3, the moment will be absorbed and released by the elastic means 11 prior to contact of the shell 3 with the piston 4. The shell 3 will thus recover its stable state thanking for the restoring force of the elastic means 11.

In accordance with the abrasion preventing device according to either the primary embodiment or the second embodiment, the high stiffness elastic means 11 is placed about the coupling projection 3a of the shell 3, so that the elastic means 11 absorbs the moment caused by the striking of the slider on the shell 3 during the operation of the compressor. The abrasion prevent device thus prevents possible abrasion of the coupling portion between the shell 3 and the piston 4. Furthermore, the abrasion prevent device intercepts the impact moment to be transmitted to the piston 4, thus to prevent possible abrasion of the piston 4.

Turning to FIG. 2C, there is shown an abrasion preventing device according to a third embodiment of this invention. A part of the piston 4 is axially hollowed and provided with diametrically opposed radial through holes 17 formed on the side wall of the hollowed section of the piston 4. In this device, the coupling projection 3a of the shell 3 has a configuration similar to the projection 3a of either the primary embodiment or the second embodiment. In order to couple the shell 3 to the piston 4, the projection 3a of the shell 3 is inserted into the cavity of the partially hollowed piston 4 so that the through hole 3b of the projection 3a is aligned with the diametrically opposed holes 17 of the piston 4. Thereafter, a coupling pin 18 is inserted into both the holes 17 of the piston 4 and the hole 3b of the projection 3a of the shell 3, thus to couple the shell 3 to the piston 4. Differently from both the primary embodiment and the second embodiment, the abrasion preventing device according to the third embodiment achieves the abrasion preventing coupling of the shell 3 to the piston 4 by the coupling pin 18 using no elastic means 11. The abrasion preventing device according to the third embodiment thus reduces the number of the parts and reduces the cost in comparison with both the primary embodiment and the second embodiment.

As described above, an abrasion preventing device in accordance with the present invention pivotally couples the shell to the piston, thus to remarkably reduce the frictional abrasion of the coupling portion between the slider and the shell. The device also prevents the frictional abrasion of the piston reciprocating in the cylinder. The device thus not only improves consume resistance of the compressor but also achieves both high operational efficiency and low level noise of the compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An abrasion preventing device for a hermetic reciprocating compressor comprising:

a cylinder;

a piston received and reciprocating in the cylinder, an end of said piston having a coupling projection;

a shell coupled to said piston, said shell having a coupling projection;

means for coupling the piston to the shell by coupling the projections of both the piston and the shell to each other; and elastic means provided on a coupling portion between the piston and the shell for absorbing an impact moment caused by striking of a slider on the shell during an operation of the compressor.

2. The abrasion preventing device according to claim 1, wherein said piston further includes at least one additional coupling projection.

3. The abrasion preventing device according to claim 1, wherein a width of the coupling projection of the piston is twice the width of the coupling projection of the shell.

4. The abrasion preventing device according to claim 1, wherein each of the projections is provided with at least one coupling hole.

5. The abrasion preventing device according to claim 1, wherein said coupling means comprises a bolt and a nut.

6. An abrasion preventing device for a hermetic reciprocating compressor comprising:

a cylinder;

a piston received and reciprocating in the cylinder, said piston being axially partially hollowed and having diametrically opposed radial through holes formed on the side wall of a hollowed section of the piston;

a shell coupled to said piston, said shell having a coupling projection; and means for coupling the piston to the shell by coupling the projection of the shell to said through holes of the piston.

7. The abrasion preventing device according to claim 6, wherein said coupling means is a pin inserted into both the through holes of the piston and a hole provided in the coupling projection of the shell.

* * * * *